US011655645B2

(12) United States Patent
Ritenour

(10) Patent No.: US 11,655,645 B2
(45) Date of Patent: May 23, 2023

(54) POOL WALL ASSEMBLIES, SYSTEMS, AND METHODS THEREOF

(71) Applicant: Pool Walls LLC, Stanley, VA (US)

(72) Inventor: Darris Ritenour, Stanley, VA (US)

(73) Assignee: POOL WALLS LLC, Stanley, VA (US)

( * ) Notice: Subject to any disclaimer, the term of this patent is extended or adjusted under 35 U.S.C. 154(b) by 24 days.

(21) Appl. No.: 17/480,036

(22) Filed: Sep. 20, 2021

(65) Prior Publication Data

US 2022/0098885 A1 Mar. 31, 2022

Related U.S. Application Data

(60) Provisional application No. 63/083,766, filed on Sep. 25, 2020.

(51) Int. Cl.
*E04H 4/00* (2006.01)

(52) U.S. Cl.
CPC ..... *E04H 4/0081* (2013.01)

(58) Field of Classification Search
CPC ..... E04H 4/0081
USPC ..... 4/506, 507, 488
See application file for complete search history.

(56) References Cited

U.S. PATENT DOCUMENTS

| | | | | |
|---|---|---|---|---|
| 3,600,722 | A * | 8/1971 | Diemond | E04H 4/0018 52/169.7 |
| 3,720,064 | A * | 3/1973 | Hall | E04H 4/00 405/55 |
| 3,906,688 | A * | 9/1975 | Witte | E04H 4/142 248/351 |
| 3,975,782 | A * | 8/1976 | Lankheet | E04H 4/142 4/506 |
| 4,843,658 | A * | 7/1989 | Hodak | E04H 4/0081 52/169.9 |
| 5,419,656 | A * | 5/1995 | McKinnon | E04H 4/005 405/55 |
| 9,062,449 | B2 * | 6/2015 | Burks | E04H 9/14 |
| 11,434,650 | B2 * | 9/2022 | Clark | E04G 17/0658 |
| 2005/0091934 | A1 * | 5/2005 | Kantor | E04H 4/0043 52/155 |
| 2012/0031027 | A1 * | 2/2012 | Burks | E04H 9/14 52/745.12 |
| 2021/0164250 | A1 * | 6/2021 | Clark | E04G 17/0658 |

FOREIGN PATENT DOCUMENTS

| | | | | |
|---|---|---|---|---|
| CA | 2591022 | A1 * | 11/2008 | E04H 4/0043 |

* cited by examiner

*Primary Examiner* — Lori L Baker
(74) *Attorney, Agent, or Firm* — Snell & Wilmer L.L.P.

(57) ABSTRACT

A pool wall segment for use in a pool wall system may comprise: a first sidewall; a second sidewall disposed opposite the first sidewall, the first sidewall and second sidewall defining a cavity therebetween; and a webbing system disposed between the first sidewall and the second sidewall, the webbing system configured to hold a rebar.

18 Claims, 6 Drawing Sheets

SECT A-A

SECT B-B

SECT B-B

POOL WALL ASSEMBLIES, SYSTEMS, AND METHODS THEREOF

CROSS-REFERENCE TO RELATED APPLICATIONS

This application is a non-provisional of, and claims priority to, and the benefit of U.S. Provisional Application No. 63/083,766, entitled "POOL WALL ASSEMBLIES, SYSTEMS, AND METHODS THEREOF," filed on Sep. 25, 2020, which is hereby incorporated by reference in its entirety.

FIELD

The present disclosure relates to a pool systems, and more specifically to pool systems having pool wall segments defining a pool wall structure.

BACKGROUND

Typical pool structures include various types of pool walls. For example, typical pool walls include plywood walls, steel walls, and polycarbonate walls. Plywood walls have many disadvantages, such as deterioration from rot, mold growing in the porous surface of the plywood walls, etc. Steel walls may be susceptible to rust if not properly installed and/or maintained. Additionally, steel walls may be costly relative to other pool wall systems. Polycarbonate pool walls may be more susceptible to climate relative to other pool wall systems.

Alternative pool structures include fiberglass pool walls or concrete pool walls. Fiberglass pool walls may be very expensive, difficult to level, and difficult to keep in the ground if not installed properly. Additionally, fiberglass pool walls are not customizable. Concrete pool walls are the most expensive and time consuming of typical pool walls. Additionally, concrete pool walls may have significant upkeep.

SUMMARY

Disclosed herein, is a pool wall system for use in a pool structure. In various embodiments, a pool wall system includes a plurality of pool wall segments. The plurality of pool wall segments may be aligned and oriented to define a perimeter of a pool wall structure. Each pool wall segment in the plurality of pool wall segments may include a first sidewall, a second sidewall, and a webbing disposed between the first sidewall and the second sidewall. In various embodiments, a first pool wall segment may be coupled to a second pool wall segment via a locking system or the like. For example, a locking system may comprise a snap coupling and a pin, or any other locking system known in the art, such as fasteners (e.g., bolts and nuts), or the like. In various embodiments, the pool wall system further comprises a plurality of reinforcing bars, hereinafter referred to as "rebar." A first plurality of rebar may be oriented vertically through a cavity defined by the first sidewall and the second sidewall and be spaced around the perimeter of the pool structure. Similarly, a second plurality of rebar may be oriented around the perimeter of the pool structure within the cavity and spaced apart vertically. In various embodiments, the webbing may support the second plurality of rebar to keep the rebar in place during a step of pouring concrete. In various embodiments, the pool wall system is configured to structurally support a horizontal hydraulic pressure, as well as a vertical pressure, with significant cost savings for construction. In various embodiments, the pool wall system may be more efficient to manufacture and/or more customizable relative to typical pool wall systems.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
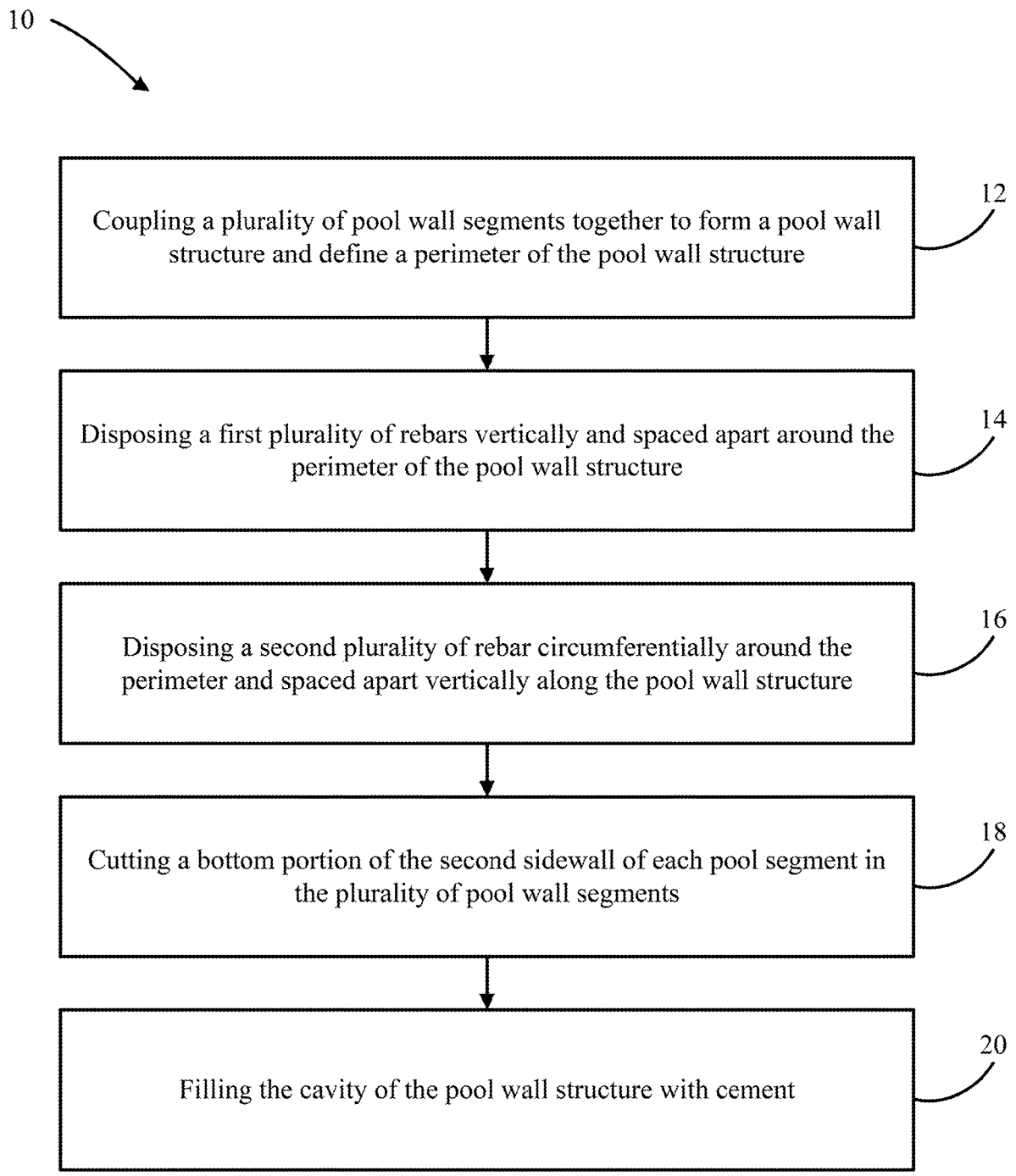
FIG. 1 illustrates a method of assembling a pool wall system, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. The detailed description herein is presented for purposes of illustration only and not of limitation.

Referring now to FIG. 1, a method of assembling a pool wall structure, in accordance with various embodiments, is illustrated. The method 10 comprises coupling a plurality of pool wall segments together to form a pool wall structure and define a perimeter of the pool wall structure (step 12). Each pool segment in the plurality of pool segments is disposed adjacent to a first adjacent pool segment and a second adjacent pool segment. Each pool segment in the plurality of pool segments comprises a first sidewall, a second sidewall, and a webbing system disposed between the first sidewall and the second sidewall. In various embodiments, the first sidewall and the second sidewall may be between 4 inches (10 cm) and 8 inches (20 cm) apart, or approximately 6 inches (15 cm) apart. In various embodiments the first sidewall and the second sidewall may define a cavity therebetween configured to receive concrete. In this regard, each pool wall segment in the plurality of pool wall segments may comprise a concrete form (i.e., a shell configured to receive concrete therein. This is in contrast to typical concrete pool walls, which form the entire pool wall. In this regard, typical concrete pool walls use significantly more concrete than the present disclosure, which adds significant cost. Additionally, typical concrete pool walls have the concrete adjacent to the water disposed in the pool, and the concrete may have a rough surface, which can be undesirable for users of a respective pool with typical concrete pool walls.

In various embodiments, the method 10 further comprises disposing a first plurality of rebar vertically and spaced apart around the perimeter of the pool wall structure (step 14). In various embodiments, the first plurality of rebar may extend significantly above a top of the plurality of pool wall segments (e.g., between 2 and 6 feet, or approximately 4 feet above a top end of the pool wall structure). In this regard, the first plurality of rebar may later be bent outward from the perimeter of the pool wall structure and configured to provide structural support to a deck of the pool.

In various embodiments, the method 10 further comprises disposing a second plurality of rebar around the perimeter of the pool structure and spaced apart vertically along the pool wall structure (step 16). The first plurality of rebar and the second plurality of rebar may be configured to strengthen and aid concrete placed under tension.

In various embodiments, the method 10 further comprises cutting a bottom portion of the second sidewall of each pool segment in the plurality of pool wall segments (step 18). Although described herein as including step 18, the present disclosure is not limited in the regard. For example, in various embodiments, each pool segment in the plurality of pool segments may be manufactured with the bottom portion of the second sidewall already cut. Although described herein as being cut, the present disclosure is not limited in this regard. For example, each pool wall segment may be cast or formed with the cutout, in accordance with various embodiments. In various embodiments, the second sidewall may be configured to be an outer sidewall. In various embodiments, the bottom portion of the second sidewall of each pool segment may be cut at a height between 4 inches (10 cm) and 8 inches (20 cm), or approximately 6 inches (15 cm). In various embodiments, by cutting the second sidewall of each pool segment, the concrete that is disposed in the cavity of the pool wall structure may be integral with the concrete of the footer. "Integral," as defined herein refers to being formed of a single unitary component (e.g., monolithic).

In various embodiments, the method 10 further comprises filling the cavity of the pool wall structure with concrete (step 20). In various embodiments, when filling the cavity with concrete, a footer surrounding a bottom of the pool wall structure may be formed. In various embodiments, the footer may extend outward from the first sidewall to between 1.5 feet and 3 feet, or approximately 2 feet.

Figure 2:
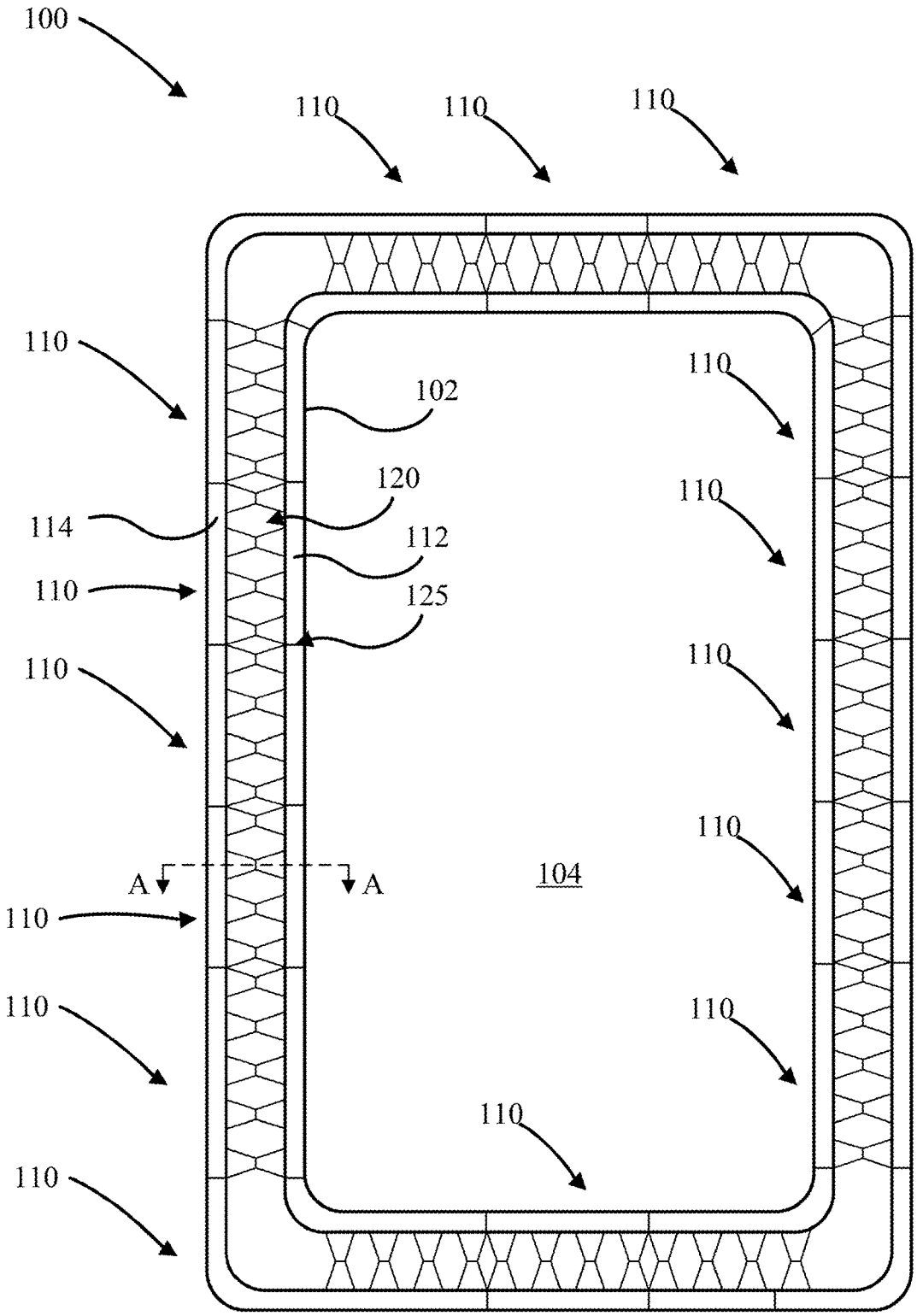
FIG. 2 illustrates a top down view of a pool wall system during assembly, in accordance with various embodiments.

Referring now to FIG. 2, a top down view of a pool wall system 100 after step 12 of method 10 is illustrated, in accordance with various embodiments. In various embodiments, the pool wall system 100 includes a plurality of pool wall segments 110. The plurality of pool wall segments 110 may define a perimeter of a pool wall structure 102 of the pool wall system 100. For example, each pool wall segment in the plurality of pool wall segments 110 may be coupled to a first adjacent pool wall segment and a second adjacent pool wall segment in the plurality of pool wall segments 110. In various embodiments, the first pool wall segment may be coupled to a second pool wall segment via a locking system 125, or the like. For example, a locking system 125 may comprise a snap coupling and a pin, or any other locking system known in the art, such as fasteners (e.g., bolts and nuts), or the like. The pool wall structure 102 defines a cavity 104 configured to receive a fluid therein, such as water.

In various embodiments, by utilizing a plurality of pool wall segments 110, each pool wall segment in the plurality of pool wall segments 110 may be customizable to define a predetermined perimeter of the pool wall structure 102. Thus, the plurality of pool wall segments 110 may include pool wall segments of different shapes (e.g., curved, straight, curvilinear, etc.) and/or lengths as desired.

In various embodiments, each pool wall segment in the plurality of pool wall segments 110 comprises a first sidewall 112, a second sidewall 114 and a webbing system 120 disposed between the first sidewall 112 and the second sidewall 114. The first sidewall 112 may be configured to be an inner sidewall disposed adjacent to the cavity 104 and the second sidewall 114 may be configured to be an outer sidewall. In various embodiments, the first sidewall 112 and the second sidewall 114 may be made of a polymeric material, such as polyvinyl chloride (PVC), or any other material known in the art.

In various embodiments, the webbing system 120 may be configured to keep a plurality of rebars in place prior to locking the plurality of rebar in place with concrete. For example, the webbing system 120 may be configured to hold the second plurality of rebar in place in a lineal direction about the perimeter of the pool wall structure 102 from step 16 of method 10. In various embodiments, the webbing system 120 may be made of a polymeric material, such as PVC, or any other material known in the art. In various embodiments, the webbing system 120 may be custom fitted for various designs and shapes.

Figure 3:
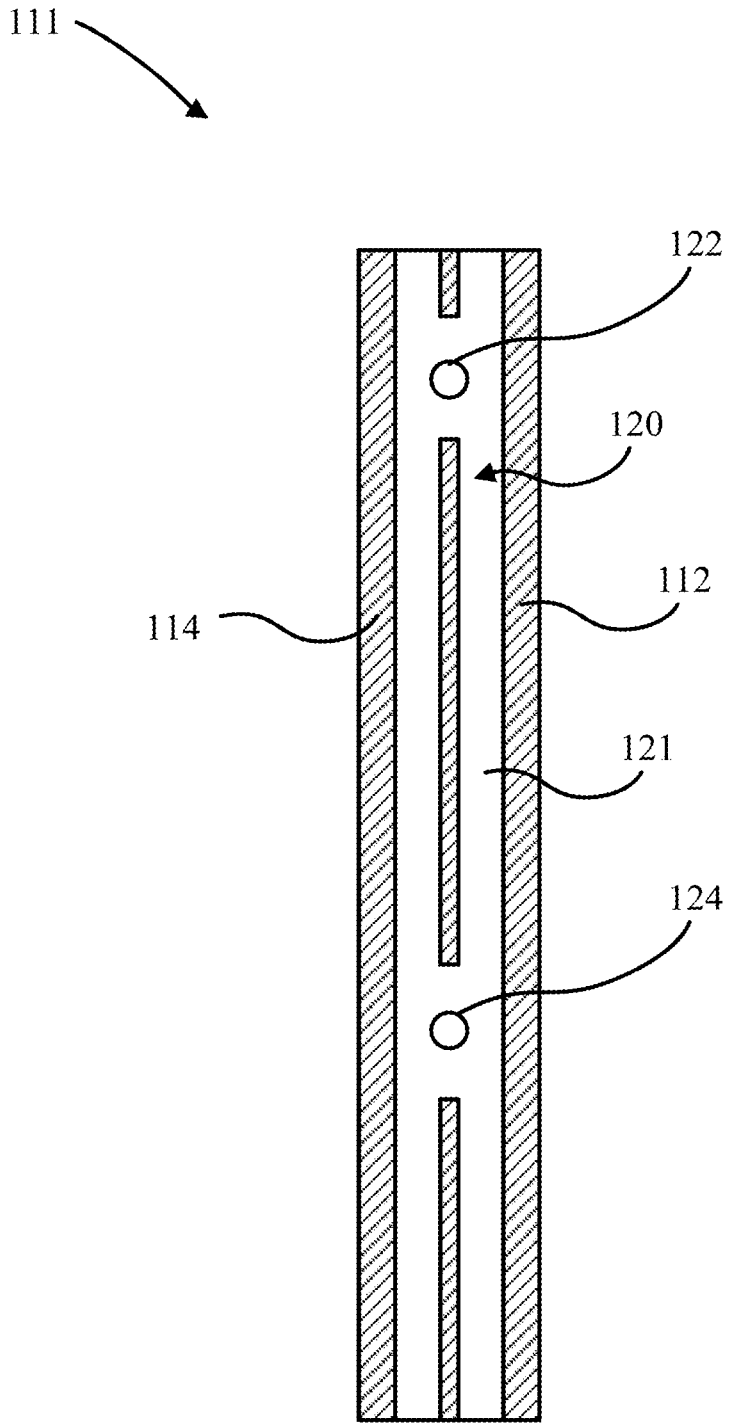
FIG. 3 illustrates a cross-sectional view of the pool wall system along section line A-A of FIG. 2, in accordance with various embodiments.

Referring now to FIG. 3, a cross-sectional view of a pool wall segment 111 in the plurality of pool wall segments 110 along section line A-A from FIG. 2 is illustrated, in accordance with various embodiments. In various embodiments, the webbing system 120 includes a webbing 121 extending from first sidewall 112 to second sidewall 114. In various embodiments the webbing 121 includes a first aperture 122 aligned in a direction along the perimeter of the pool wall segment 111. The first aperture 122 may be configured to receive a rebar therethrough. In various embodiments, the webbing 121 may further comprise a second aperture 124 spaced apart vertically from the first aperture 122. Although illustrated as comprising two apertures, the present disclosure is not limited in this regard. For example, a number of apertures may be sized and configured based on a height of the pool wall segment 111 and/or the application of the pool wall segment.

Figure 4:
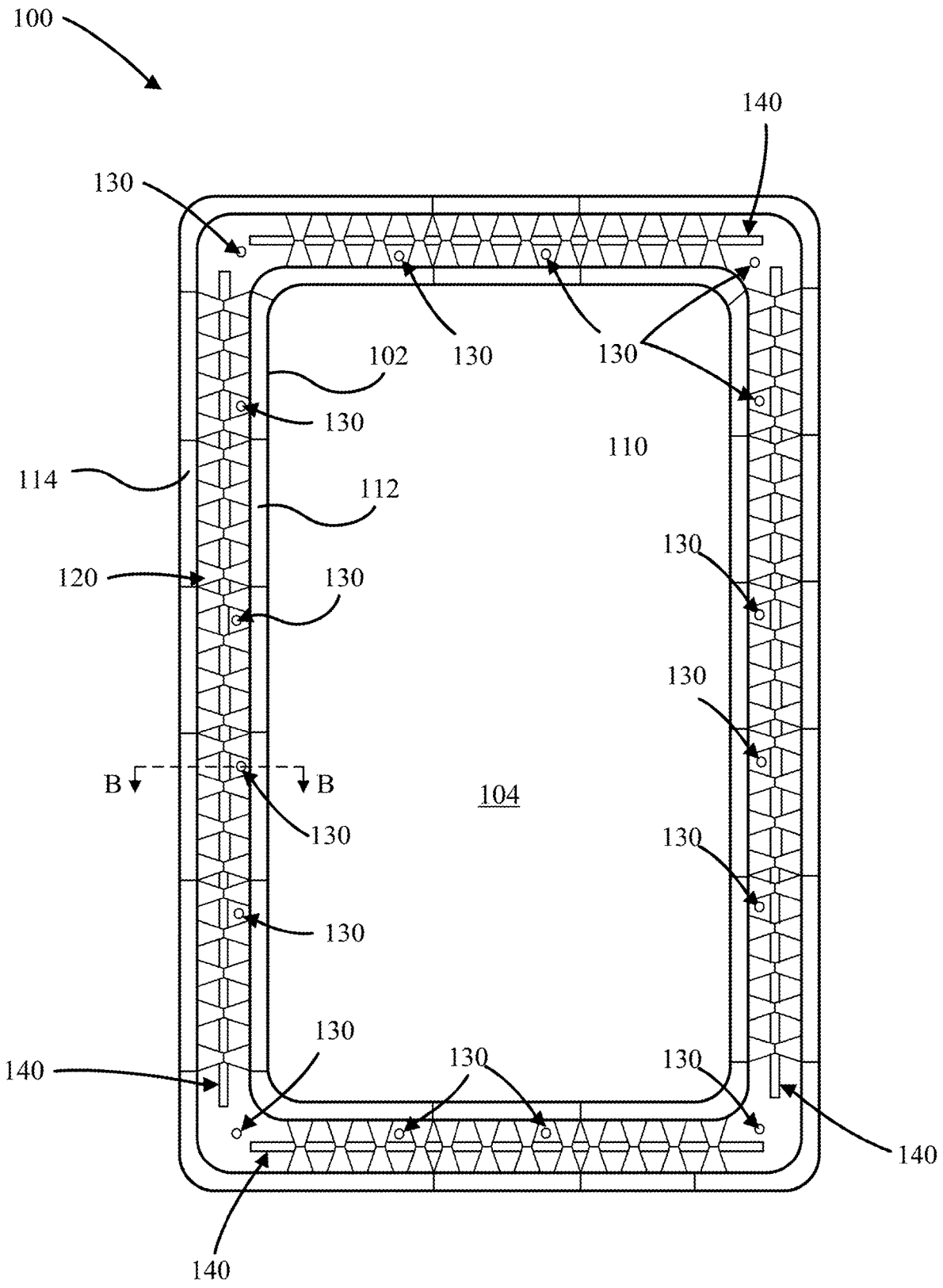
FIG. 4 illustrates a top down view of a pool wall system during assembly, in accordance with various embodiments.

Referring now to FIG. 4, a top down view of a pool wall system 100 after step 16 of method 10 is illustrated, in accordance with various embodiments. In various embodiments, the pool wall system 100 further comprises a first plurality of rebar 130 and a second plurality of rebar 140. In various embodiments, the first plurality of rebar 130 are disposed around the perimeter of the pool wall structure 102. In various embodiments, each rebar in the first plurality of rebar 130 are disposed in a vertical direction. In this regard, the first plurality of rebar 130 are configured to compensate for imbalance in concrete from step 20 of method 10 in the vertical direction (e.g., a tensile load in the vertical direction).

In various embodiments, the second plurality of rebar 140 is disposed around the perimeter of the pool wall structure 102. In various embodiments, the second plurality of rebar 140 may be disposed through the apertures 122, 124 of webbing system 120 from FIG. 3. In this regard, the second plurality of rebar 140 are configured to compensate for an imbalance in concrete from step 20 of method 10 along the perimeter of the pool wall structure 102 (e.g., a tensile load in a horizontal direction).

Figure 5:
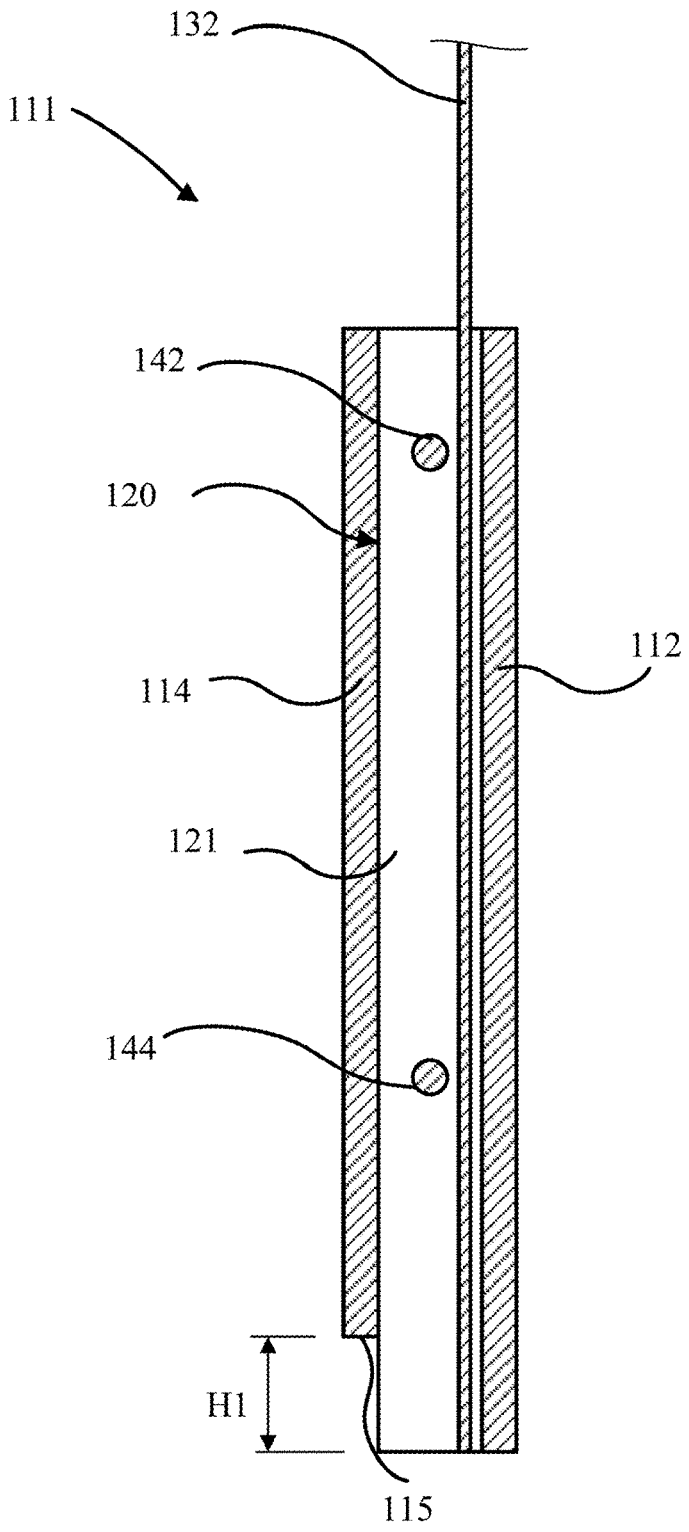
FIG. 5 illustrates a cross-sectional view of the pool wall system along section line B-B of FIG. 4, in accordance with various embodiments.

Referring now to FIG. 5, a cross-sectional view of a pool wall segment 111 in the plurality of pool wall segments 110 along section line B-B from FIG. 4 after step 18 of method 10 is illustrated, in accordance with various embodiments. In various embodiments, a vertical rebar 132 in the first plurality of rebar 130 from FIG. 4 extends from a proximal end of the pool wall segment 111 vertically between the first sidewall 112 and the second sidewall 114. In various embodiments, the vertical rebar 132 extends above a distal end of the pool wall segment 111. The vertical rebar 132 may extend a distance above the distal end of the pool wall segment 111 based on a desired deck size of the pool wall system 100. For example, if a four-foot-wide deck is desired, the vertical rebar 132 may extend approximately four feet above the distal end of the pool wall segment 111. In this regard, after concrete is poured in step 20 of method 10, the first plurality of rebar 130 from FIG. 4 may all be bent radially outward. For example, vertical rebar 132 may be bent towards second sidewall 114 and act as a structural support for a deck disposed around the pool wall structure 102 from FIG. 4.

In various embodiments, a first rebar 142 and a second rebar 144 in the second plurality of rebar 140 from FIG. 4 may be disposed through apertures 122, 124 from FIG. 3 via step 14 from method 10. In various embodiments, the first rebar 142 and the second rebar 144 are spaced apart vertically and oriented along the perimeter of the pool wall structure. In this regard, the first rebar 142 and the second rebar 144 are configured to compensate for an imbalance in concrete in the direction along the perimeter of the pool wall structure. The first rebar 142 and the second rebar 144 may extend along the perimeter of the pool wall structure, in accordance with various embodiments.

In various embodiments, a bottom portion of the second sidewall 114 may be cut via step 18 of method 10. In this regard, a bottom portion 115 of the second sidewall may be a height H1 above the first sidewall 112. In various embodiments, the height H1 may be between 4 inches (10 cm) and 12 inches (30 cm), or approximately 8 inches (20 cm). In various embodiments, by cutting second sidewall 114 as disclosed herein, a footer of the pool structure created from the pouring concrete step (e.g., step 20 of method 10) may be integral with the concrete disposed between first sidewall 112 and second sidewall 114. In this regard, the pool wall structure 102 from FIG. 4 may be more robust relative to typical pool wall structures.

Figure 6:
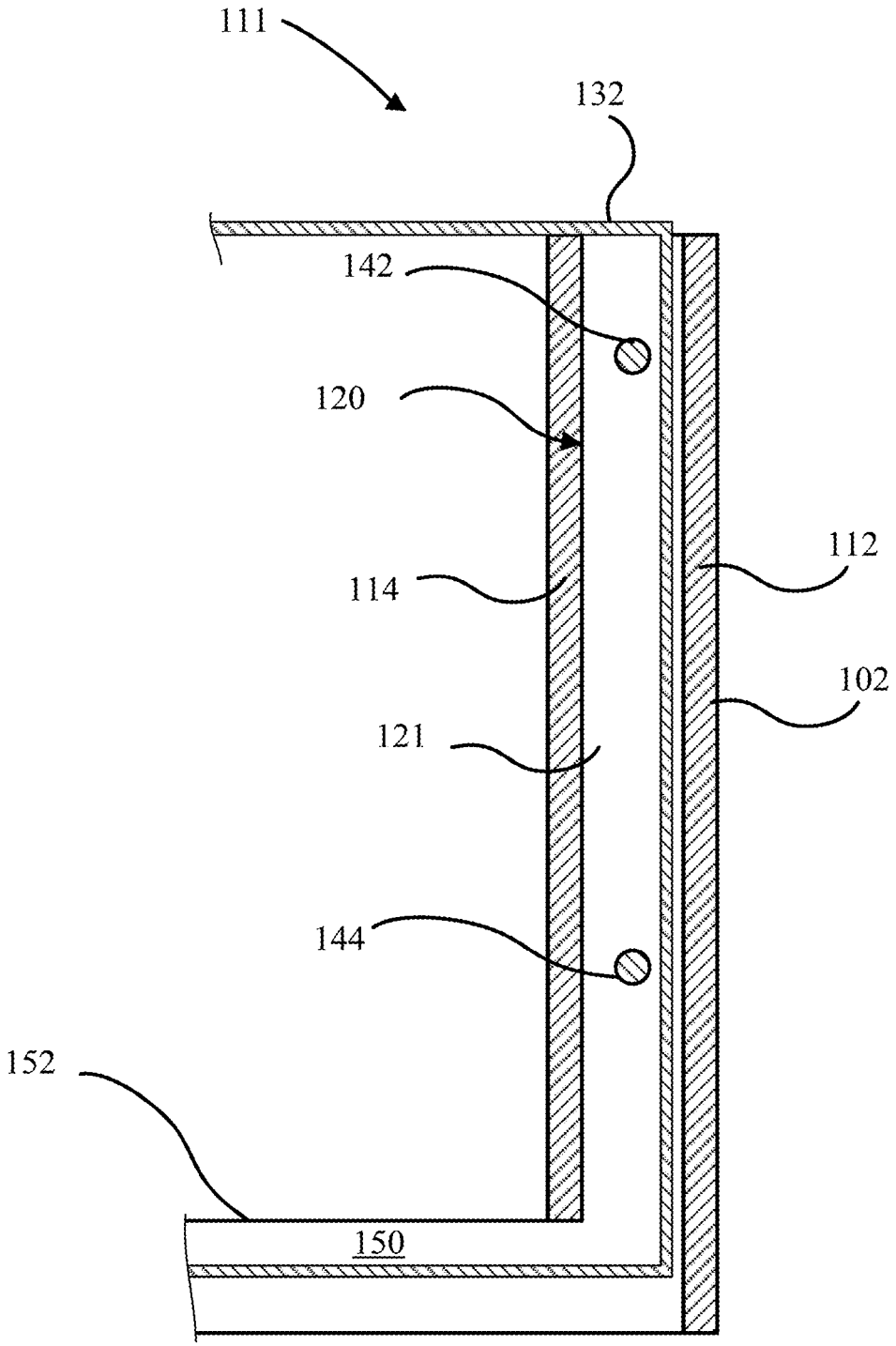
FIG. 6 illustrates a cross-sectional view of the pool wall system along section line B-B of FIG. 4, in accordance with various embodiments.

Referring now to FIG. 6, a cross-sectional view of a pool wall segment 111 in the plurality of pool wall segments 110 along section line B-B from FIG. 4 after step 20 of method 10 is illustrated, in accordance with various embodiments. In various embodiments, the vertical rebar 132 may be bent at a bottom portion of the pool wall segment 111 and at a top portion of the pool wall segment 111. In this regard, the vertical rebar 132 from FIG. 5 may form a rebar with three segments (e.g., two horizontal segments at a base of the pool wall segment 111 and a top of the pool wall segment 111 to support a surrounding deck).

In various embodiments, after bending vertical rebar 132, concrete 150 is poured in a cavity defined between the first sidewall 112 and the second sidewall 114. The concrete 150 may flow through the cavity and out the cut portion of the second sidewall 114 to form a footer 152 of the pool wall structure 102. Although illustrated as being flush with the cut portion of the second sidewall 114, the pool wall system 100 is not limited in this regard. For example, the concrete 150 may extend above the cut portion of the second sidewall 114 in accordance with various embodiments. Similarly, although the concrete is illustrated as filling the cavity defined between the first sidewall 112 and the second sidewall 114, the present disclosure is not limited in this regard. For example, the cavity may be partially filled in accordance with various embodiments. In various embodiments, the plurality of pool wall segments 110 may be backfilled with a material giving at least 90% compaction without the use of a compacting device.

In various embodiments, a pool wall system 100 as disclosed herein may provide greater strength relative to typical pool wall systems. In various embodiments, a pool wall system 100 may be easier to assemble relative to typical pool wall systems. In various embodiments, the pool wall system 100 may be more cost effective relative to typical pool wall systems. In various embodiments, the pool wall system 100 may have a greater life relative to typical pool wall systems.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in a different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of manufacture to form a pool wall structure, comprising:

coupling a plurality of pool wall segments together to form the pool wall structure that defines a perimeter of a pool;

disposing a first plurality of rebar vertically within the pool wall structure, the first plurality of rebar being spaced apart around the perimeter of the pool wall structure;

disposing a second plurality of rebar around the perimeter of the pool wall structure;

filling a cavity of the pool wall structure with concrete; and cutting a bottom portion of a second sidewall of each pool wall segment in the plurality of pool wall segments prior to filling the cavity of the pool wall structure.

2. The method of claim 1, further comprising bending the first plurality of rebar outward from the perimeter.

3. The method of claim 1, wherein each pool wall segment in the plurality of pool wall segments comprises a webbing system disposed between a first sidewall and the second sidewall.

4. The method of claim 3, wherein the webbing system comprises webbing extending from the first sidewall to the second sidewall.

5. The method of claim 3, wherein the first sidewall and the second sidewall define the cavity therebetween.

6. The method of claim 1, further comprising disposing a third plurality of rebar around the perimeter of the pool wall structure, the third plurality of rebar spaced apart from the second plurality of rebar in a vertical direction.

7. A pool wall segment for use in a pool wall system, the pool wall segment comprising:

a first sidewall;

a second sidewall disposed opposite the first sidewall, the first sidewall and the second sidewall defining a cavity therebetween;

a webbing system disposed between the first sidewall and the second sidewall, the webbing system configured to hold a rebar; and a locking system, wherein the locking system is configured to couple the pool wall segment to an adjacent pool wall segment.

8. The pool wall segment of claim 7, wherein the cavity defines a form configured to receive concrete.

9. The pool wall segment of claim 7, wherein the webbing system includes a webbing extending from the first sidewall to the second sidewall.

10. The pool wall segment of claim 9, wherein the webbing includes a first aperture disposed in a horizontal direction through the webbing, the first aperture configured to hold the rebar.

11. The pool wall segment of claim 7, wherein the first sidewall and the second sidewall are made of a polymeric material.

12. The pool wall segment of claim 11, wherein the webbing system is made of a second polymeric material.

13. A pool wall system, comprising:

a plurality of pool wall segments defining a perimeter of a pool wall structure;

a first plurality of rebar, each rebar in the first plurality of rebar including a first portion extending in a vertical direction through the plurality of pool wall segments;

a second plurality of rebar, each rebar in the second plurality of rebar extending around the perimeter of the pool wall structure; and a concrete disposed in a cavity of each pool wall segment in the plurality of pool wall segments, wherein each rebar in the first plurality of rebar includes a second portion extending in a horizontal direction proximate a first vertical end of the pool wall structure.

14. The pool wall system of claim 13, wherein each rebar in the first plurality of rebar includes a third portion extending in the horizontal direction proximate a second vertical end of the pool wall structure.

15. The pool wall system of claim 14, further comprising a footer disposed proximate the second vertical end of the pool wall structure, the footer extending outward from the perimeter.

16. The pool wall system of claim 15, wherein the concrete forms the footer.

17. The pool wall system of claim 16, wherein the third portion of each rebar in the first plurality of rebar is encapsulated within the footer.

18. A pool wall segment for use in a pool wall system, the pool wall segment comprising:

a first sidewall;

a second sidewall disposed opposite the first sidewall, the first sidewall and the second sidewall defining a cavity therebetween; and a webbing system disposed between the first sidewall and the second sidewall, the webbing system configured to hold a rebar, wherein:

the webbing system includes a webbing extending from the first sidewall to the second sidewall, and the webbing includes a first aperture disposed in a horizontal direction through the webbing, the first aperture configured to hold the rebar.

* * * * *